United States Patent [19]

Taylor

[11] Patent Number: 4,489,565

[45] Date of Patent: Dec. 25, 1984

[54] PROCESS COOLING METHOD AND APPARATUS UTILIZING AEROSOL SPRAYS

[75] Inventor: Theodore B. Taylor, Damascus, Md.

[73] Assignee: Nova, Inc., Gaithersburg, Md.

[21] Appl. No.: 505,092

[22] Filed: Jun. 16, 1983

[51] Int. Cl.[3] ..... F25C 5/18

[52] U.S. Cl. ..... 62/59; 62/121; 261/119 R; 261/128; 261/151; 261/DIG. 79

[58] Field of Search ..... 62/121, 310, 59; 261/DIG. 79, 119 R, 128, 151, 78 A

[56] References Cited

U.S. PATENT DOCUMENTS

| | | | |
|---|---|---|---|
| Re. 27,853 | 12/1973 | Frohwerk | 261/DIG. 79 |
| 382,156 | 5/1888 | Hanford | 261/78 A |
| 644,364 | 2/1900 | McKay | 62/310 |
| 1,931,347 | 10/1933 | Gay . | |
| 2,340,721 | 2/1944 | Whitney . | |
| 2,591,100 | 4/1952 | Rouse | 261/DIG. 79 |
| 2,628,485 | 2/1953 | Toulmin . | |
| 2,737,027 | 3/1956 | Kleist | 62/59 X |
| 3,024,117 | 3/1962 | Barlow . | |
| 3,121,626 | 2/1964 | Zarchin . | |
| 3,183,679 | 5/1965 | Mohlman et al. . | |
| 3,204,419 | 9/1965 | Rose . | |
| 3,212,999 | 10/1965 | Sommers . | |
| 3,220,203 | 11/1965 | Rose . | |
| 3,242,058 | 3/1966 | Ganley . | |
| 3,299,651 | 1/1967 | McGrath . | |
| 3,425,235 | 2/1969 | Cox . | |
| 3,666,246 | 5/1972 | Cohen | 261/151 |
| 3,714,791 | 2/1973 | Peck . | |
| 4,046,534 | 9/1977 | Maguire . | |
| 4,091,635 | 5/1978 | Ogman . | |
| 4,143,524 | 3/1979 | Thijssen . | |
| 4,291,550 | 9/1981 | Engdahl et al. . | |
| 4,314,455 | 2/1982 | Engdahl . | |
| 4,341,085 | 7/1982 | Nail . | |
| 4,347,703 | 10/1982 | Lukasavage . | |

OTHER PUBLICATIONS

"Boston Firm has Cool Idea for Atlantic City", by Joseph Donohue, The Press, Atlantic City, N.J., Wednesday, Jul. 28, 1982, p. 35.

"The Ice Mound Cometh", by Robert Buyer, Empire State Report, Apr. 1983, pp. 52–53.

"Our Far-Flung Correspondents-Ice Pond", NEWYORKER, Jul. 13, 1981, pp. 92–95, by John McPhee.

"Teb Taylor Built Bombs. Now He's Thinking Solar.", by Douglas Colligan, Technology Illustrated, Apr./May 1982, pp. 41–44.

"The Ice Pond-Production and Seasonal Storage of Ice for Cooling", by D. L. Kirkpatrick, et al., Princeton Univ., Center for Energy and Environmental Studies, Aug. 1982, PU/CEES Report No. 149 and No. 149A (Shortened Version of No. 149).

*Primary Examiner*—William E. Tapolcai

*Attorney, Agent, or Firm*—Parkhurst & Oliff

[57] ABSTRACT

A method and apparatus for the provision of cooling through the utilization of aerosol sprays is disclosed. The hot water output of a load device is stored until low ambient temperatures exist, whereupon the hot water is atomized and exposed to the ambient air to be cooled thereby. A spray cooling system can also be combined with an artificial ice making system to provide even lower load device input temperatures. Specialized insulating devices can be used in connection with the artificially made ice to decrease the heat transfer between the ice and the ambient air during warm weather.

7 Claims, 8 Drawing Figures

PROCESS COOLING METHOD AND APPARATUS UTILIZING AEROSOL SPRAYS

BACKGROUND OF THE INVENTION

This invention relates to methods and apparatus whereby cooling requirements of various processes may be met. More specifically, this invention relates to methods and apparatus for satisfying the cooling loads of such a process in a climate where temperatures at or below the required input temperature of the cooling load exist at least part of the year.

In the past, the most common mechanism by which cooling loads have been satisfied in industrial processes has been through the provision of compressor driven cooling devices. While these devices are generally relatively compact and are capable of delivering high capacities of cooling, they are expensive both in terms of operating costs and initial expenditures, and are subject to relatively high maintenance requirements.

Previously, it has been suggested to utilize ice formed naturally during the winter for process cooling. It has even been suggested to artificially create the ice through the crystallization of a water spray introduced to subfreezing ambient air. However, these proposed methods suffer from the defect in that they must provide for a sufficient volume of ice for the entire cooling load required during those portions of the year when ice is not naturally available. As a result, these installations are large and the associated costs are high.

SUMMARY OF THE INVENTION

Accordingly, it is an object of the present invention to provide process cooling through a method and apparatus which are capable of drawing cooling loads from ambient weather conditions beyond those in which ice is naturally available. Further, it is an object of the present invention to provide such a method and apparatus which can be constructed at a relatively low cost.

Even still further, it is an object of the present invention to provide insulating means whereby the ice created during periods of subfreezing temperature may be more efficiently stored during warmer temperatures.

These and other objects are satisfied by the present invention that includes a spray cooling system in which the hot water output of the load device is stored until ambient temperatures are below the desired input temperature at the load device. The stored hot output water is then atomized and the temperature thereof is caused to decrease to the wet bulb temperature of the ambient atmosphere. The cooled water is then stored until the next period of demand imposed by the load device. The invention also includes such a spray cooling system used in combination with an artificial ice making system that creates an ice pond through the freezing of an atomized stream of water exposed to subfreezing ambient temperatures. The above-described spray cooling system is used to precool the water prior to its being introduced to the ice pond, and thereby decrease the thermal requirements placed on the ice pond during periods of warmer weather.

The insulating covers for the ice pond can comprise either an air filled bladder disposed substantially horizontally over the ice pond such that the ice therein is effectively sealed from the ambient air, or an insulating envelope in which the ice and aerosol generating apparatus are contained.

DETAILED DESCRIPTION OF THE INVENTION

The following is a detailed description of one preferred embodient of the present invention, and should be understood to be an example only.

Figure 1:
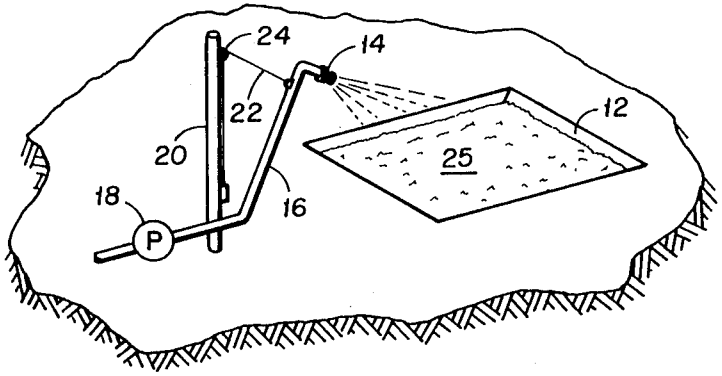
FIG. 1 is a prospective view of the spray cooling apparatus of the present invention.

The spray cooling system of the present invention is depicted in FIG. 1. In that system, a storage area 12 is formed in a surface and lined with a water impervious liner (not illustrated). While this storage area 12 will many times most conveniently be placed in the earth surface, this of course is not necessarily the case. Poised over the storage area 12 is a nozzle 14, such that the fluid flowing from nozzle 14 will be caused to fall substantially within the boundaries of storage area 12. This nozzle is fed water from a source by pump 18 through fluid conduit 16. Fluid conduit 16 and nozzle 14 are supported by vertical support member 20 and flexible cable 22, flexible cable 22 in turn secured to upright member 20 by pulley 24. The length of flexible cable 22 may be varied so as to change the position of nozzle 14 over storage area 12. The water sprayed from nozzle 14 is caused to collect in storage area to form cooling pond 25.

Figure 2:
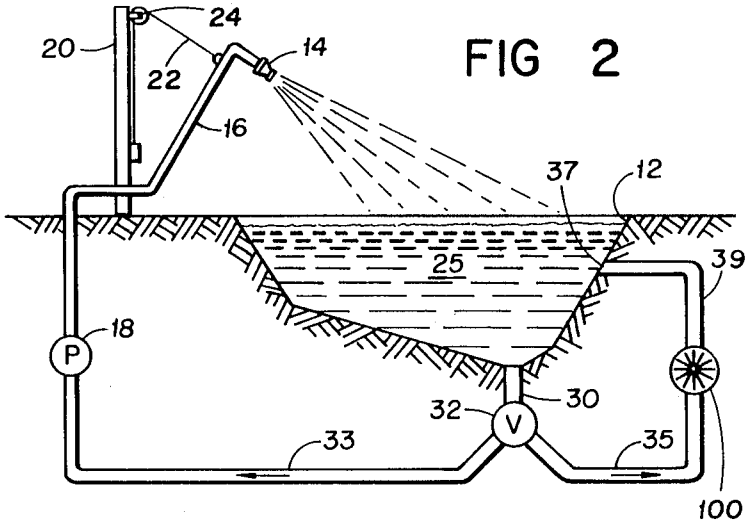
FIG. 2 is a cross sectional view of the spray cooling apparatus of the present invention, showing the fluid control means in schematic form.

As can be seen from FIG. 2, storage area 12 is provided at the bottom surface thereof with drain 30 which leads to three position valve 32. This valve 32 can either be closed, open to process conduit 35, or open to recycling conduit 33, alternatively. Recycling conduit 33 in turn leads to the input of pump 18, and consequently back into nozzle 14. Process conduit 35 leads to the thermal load device 100 which is being serviced by the spray cooling system. The hot water output of load device 100 is carried by conduit 39 back into cooling pond 25 through orifice 37.

In operation, the spray cooling system of the present invention requires a large enough storage area 12 to supply load device 100 with substantially uniform temperature input water for an entire day. During this phase, valve 32 diverts the output of drain 30 into process conduit 35 and the hot water output of load device 100 is then exhausted back into cooling pond 25. At the termination of the operation of load device 100, valve 32 is caused to assume the closed position and the cooling pond is stagnated.

When the ambient air reaches a wet bulb temperature which is lower than the required input temperature at the load device 100, valve 32 is caused to open drain 30 to recycling conduit 33 and pump 18 is turned on, thereby recycling the water held in cooling pond 25 through nozzle 14. This operation will typically take place during the coldest parts of the day, usually between the hours of 1 and 5 o'clock in the morning.

Nozzle 14 has been selected from a range of commercially available nozzles, for instance "pigtail" nozzles, such that a substantial portion of the particles existing in the aerosol stream have a diameter of less than 500 microns. Ideally, at least 20% of the total water in the stream should exist as particles of this size. In this size range, the ratio of area per unit volume existing in the aerosol stream is sufficient to allow the temperature of the particles to quickly approach very near the wet bulb temperature of the ambient air through which they are passing. Consequently, if nozzle 14 is provided with sufficient flow capacity such that the total volume of water passing through it during the course of a night is equal to approximately three times the total volume of the storage area 12, the entire storage area will be returned to within 1 or 2 degrees of the existing wet bulb temperature.

At this point, valve 32 is caused to close and pump 18 is turned off, thereby returning cooling pond 25 to a stagnant condition, but at a temperature much lower than that existing when load device 100 was initially turned off. The system is now ready for another day's operation of load device 100, whereupon valve 32 will be caused to open into process conduit 35 and the entire operation repeated.

Figure 3:
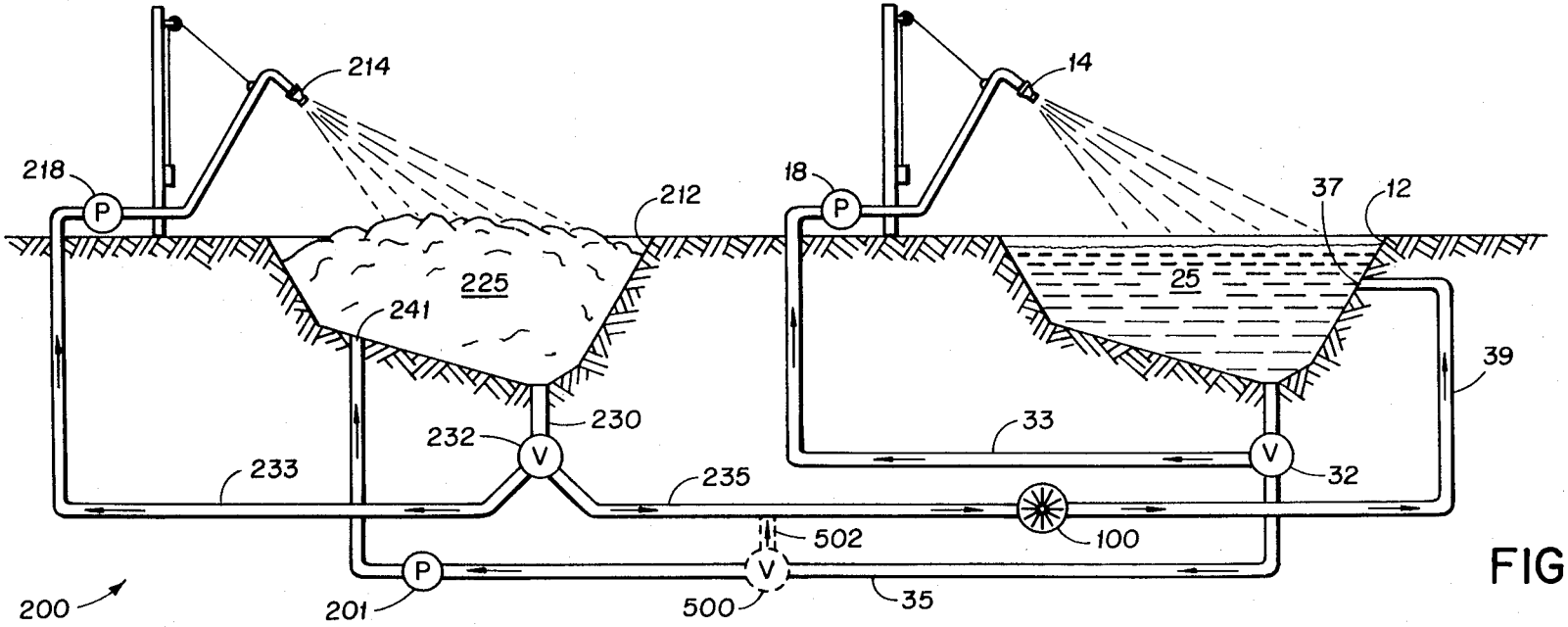
FIG. 3 is a cross sectional view of the combination spray cooling and spray freezing embodiment of the present invention.

This spray cooling system can be advantageously combined with a spray freezing system in those applications where a very low input temperature at load device 100 is desired. This combination system is illustrated in FIG. 3, where identically functioning elements to those in FIG. 2 have been given identical reference numerals. As can be seen easily from that drawing, the combination system differs from the spray cooling system in that spray freezing apparatus 200 is placed between process conduit 35 and load device 100.

Spray freezing system 200 comprises an ice storage area 212 similar to cooling storage area 12 and is also lined by a water impervious liner (not illustrated). The nozzle 214 is poised above storage area 212 through a mechanism similar to that suspending nozzle 14, and is fed by pump 218. The bottom of ice storage area 212 is supplied with a drain 230 which leads to a three position valve 232. This three position valve 232 is capable of assuming a closed position, a position in which drain 230 is connected to final process conduit 235, and a position in which drain 230 is connected to recycling conduit 233. Recycling conduit 233 in turn feeds pump 218 and consequently nozzle 214.

During a period of initial cold weather, the storage area 212 is filled or partially filled with water and valve 232 is positioned such that drain 230 is connected with recycling conduit 233. Pump 218 is turned on and nozzle 214 sprays an atomized stream of liquid into the subfreezing ambient atmosphere. Since this nozzle 214 again uses particles in the range of less than 500 microns in diameter, the particles are at least partially frozen or super cooled before they fall back into ice storage area 212. The unfrozen water is drained into drain 230 and again recycled through nozzle 214 and frozen until substantially little water remains in ice storage area 212 and the majority of the water is now ice.

At this point and time the spray cooled water in process conduit 35 is caused to flow into ice storage area 212 by pump 201 through orifice 241. As can be clearly seen from FIG. 3, orifice 241 is located at an end of ice storage area 212 substantially opposite from the end at which drain 230 is located. As a result, the cooled, but still above freezing water emerging from orifice 241 is caused to flow in contact with the ice and ice water held in ice storage 212 for a substantial distance before draining into drain 230. Valve 232 is manipulated such that drain 230 is in communication with final process conduit 235, and a now even further cooled water is supplied to load device 100.

As a result of this combination system, not only is a lower temperature of input water at load device 100 achieved, but due to the dissipation of a substantial portion of the output water heat to the atmosphere rather than to ice pile 225, the cooling loads placed upon the spray freezing portion of the system are largely reduced. Consequently, the entire spray freezing portion of the combination may be reduced in volume by a large factor—typically two to five over the size required of a spray freezing system alone. This in turn reduces the initial capital expenditures associated with the cooling system.

An alternative embodiment to that described above is set forth in FIG. 3 by phantom lines. The combination system, as modified, possesses a dual capacity in that it may be operated for spray cooling alone, or for spray cooling in combination with spray freezing as heretofore described.

The modified embodiment enables an operator to bypass the ice storage system by manipulating three-way valve 500 to direct water in conduit 35 directly to conduit 235 via conduit 502. In use, three-way valve 232 must be set so as to prevent any backflow through conduit 235. Alternatively, three-way valve 232 may be partially opened to allow a mixing of warmer water in conduit 35 with residual further cooled water in the ice storage area, thereby lowering the temperature of the water circulated to the input of the load device.

The size of the ice storage area required for a given cooling load can be even further reduced through the provision of an insulating means to prevent contact of warm ambient air with the surface of the ice 225 during periods in which ice is not naturally available.

Figure 4:
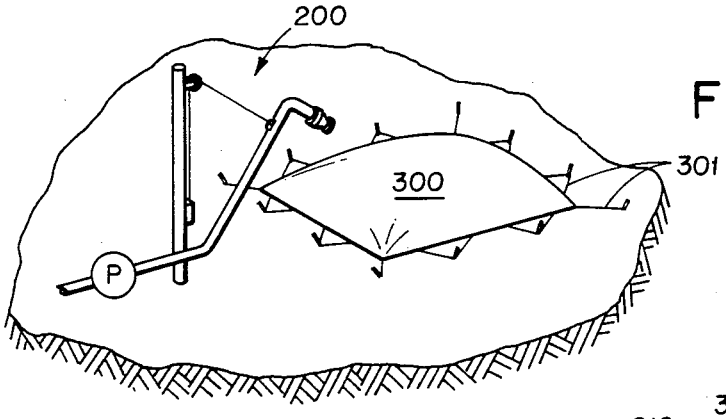
FIG. 4 is a perspective view of the insulating bladder of the present invention.
Figure 5:
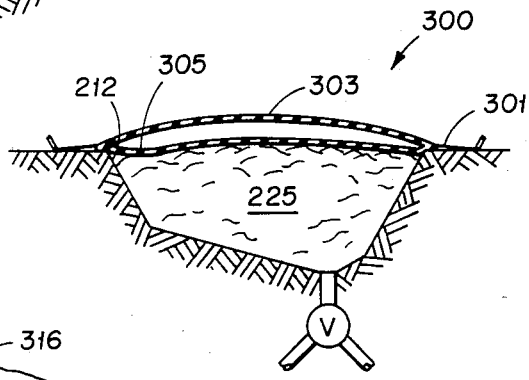
FIG. 5 is a cross sectional view of FIG. 4.

One such insulating means is illustrated in FIGS. 4 and 5, wherein bladder 300 is placed over ice storage area 212 and tethered by conventional tethering lines 301. As can be clearly seen from the cross sectional view of FIG. 5, the bladder 300 comprises a top surface 303 and a bottom surface 305 which are air tightly sealed along the perimeter to form a substantially air sealed interior. When bladder 300 is inflated it assumes a substantially flat configuration in which both top surface 303 and bottom surface 305 are substantially horizontal over a majority of their areas. Because ice pile 225 does not extend above the rim of ice storage area 212, and also has a substantially flat top surface, bottom surface 305 of bladder 300 is caused to contact the top surface of the ice. As can be clearly seen from FIG. 5, the edges of bladder 300 substantially air tightly sealed along the rims of ice storage area 212 to thereby prevent ambient air from contacting ice pile 225.

Because the bottom surface 305 of bladder 300 is cold relative to the top surface 303, there exists a stable temperature environment within bladder 300, in which natural convection cells are retarded. In other words, the cold air at the bottom surface of bladder 300 is constrained to remain there and naturally convection mixing is minimal. The flat configuration of both the top surface 303 and the bottom surface 305 of bladder 300 even further enhances this effect.

Figure 6:
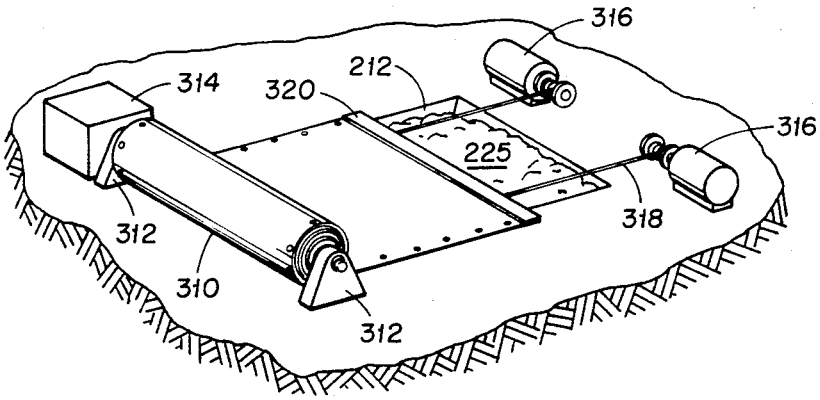
FIG. 6 is a perspective view of a means by which the bladder of the present invention may be deployed and retracted.

FIG. 6 illustrates a variation of the bladder insulating means illustrated in FIGS. 4 and 5, in which means are provided whereby the bladder can be quickly and easily extended and retracted over ice storage area 212 and ice pile 225. In this alternate embodiment, bladder 300 is rolled into a roll 310 around a spindle (not illustrated) supported at either end by support 312. This rolling can be power actuated through a conventional driving means 314. Thus, when the bladder is to be retracted, the air is let out from the interior and driving means 314 actuated, to in turn roll the entire expanse of the bladder 300 into a compact roll 310.

To extend bladder 300 and thereby reseal ice pile 225, there are provided a pair of conventional winches 316 which take up flexible cables 318. These flexible cables 318 are in turn secured to the edge of bladder 300 opposite the spindle (not illustrated) by a rigidifying member 320. When winches 316 are actuated to take up flexible cables 318, the force imparted thereby to bladder 300 is evenly distributed along one edge thereof by rigidifying member 320 and the bladder 300 is extended over ice storage 212. At this point it becomes a simple matter to reattach conventional tethering device 301 and reinflate bladder 300 into the configuration shown in FIG. 5.

Figure 7:
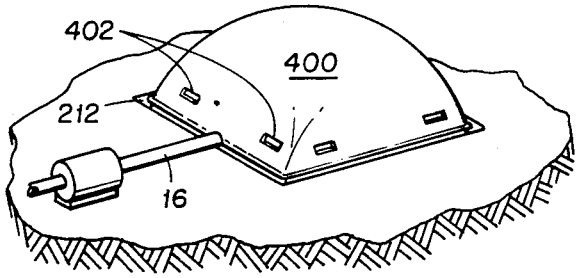
FIG. 7 is a perspective view of FIG. 7.
Figure 8:
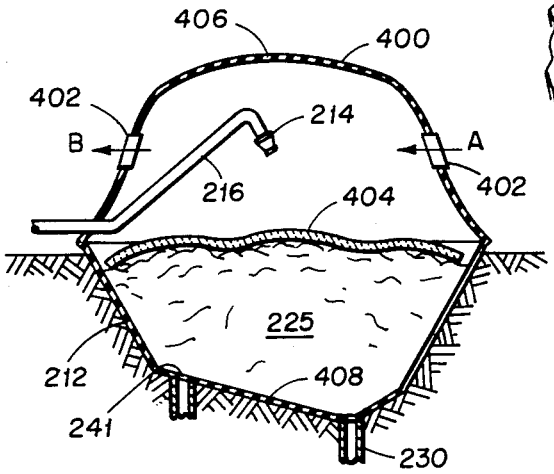
FIG. 8 is a cross sectional view of the insulating envelope of the present invention.

Another, alternate embodiment of the insulating means which is suitable for insulating and enclosing both the spray freezing and spray cooling ponds is shown in FIGS. 7 and 8. This embodiment comprises an insulating envelope 400 having a top surface 406 and a bottom surface 408 which are sealingly joined at their peripheries. Bottom surface 408 is provided with an outlet sealingly connected to drain 230, and is disposed between ice pile 225 and ice storage area 212. As such, bottom surface 408 of envelope 400 can also advantageously comprise the water proof liner by which the earth and ice pile are separated. As can be clearly seen from FIG. 8, spray nozzle 214 is located within the enclosure formed by the joining of bottom surface 408 with top surface 406. These surfaces are sufficiently dimensioned such that when envelope 400 is inflated the interior dimensions thereof are sufficient to allow nozzle 214 to operate without hindrance. An additional insulating blanket or mat 404 may be placed directly over ice pile 225 to decrease even further the heat transfer between ice pile 225 and the ambient atmosphere.

Although FIG. 8 describes the envelope 400 as containing insulating blanket 404, when insulating blanket 404 is removed, the envelope 400 allows spray freezing or spray cooling to take place normally during periods of cold weather while still providing thorough insulation during warm weather, all without being removed. This is accomplished through the provisions of input and output ducts 402 positioned in the walls of upper surface 406. These ducts can be sealed during periods when insulation is desired, or can be converted to forced air blowers to supply the interior of envelope 400 with subfreezing ambient temperatures as shown by arrows A and B.

The advantages of this particular insulating device are many. First, since the device is combined with the water proof liner already existing under ice pile 225, its provision is lower in cost than the bladder 300 or conventional insulating blanket such as 404. The input ducts 402 can be provided with filters to prevent the ingestion of contaminants such as dust, insects, and so forth. Further, since the spray nozzle 214 now exists in a constant air flow environment during spray freezing, there are encountered much fewer problems with wind shifts, such as icing of structural members and fluid conduit 216. Still further, the upper surface 406 may be provided with conventional portals such as are used in air inflated green houses and other similar structures to allow for entry and egress from the interior of envelope 400 for maintenance purposes and so forth. Due to the constant air flow environment within bladder 400, this insulation means is more suitable for the provision of automatic operation during periods of cold weather.

What is claimed is:

1. A method of supplying a cooling capacity through a combination of spray cooling and spray freezing, comprising:

(a) spraying water into a first environment having a temperature below the freezing point of the water such that the sprayed water is at least partially frozen as a result of its contact with the first environment;

(b) collecting the at least partially frozen sprayed water to an ice pond;

(c) spraying hot output water from a load device into a second environment having a temperature between the temperature of the hot output water from the load device and the freezing point thereof so that the hot output water is cooled by the second environment;

(d) collecting said cooled water;

(e) transferring said cooled water to the ice pond for further cooling; and (f) removing the further cooled water from the ice pond and inputting it into the load device.

2. A cooling method as in claim 1, wherein the collected cooled water, before being transferred to the ice pond, is resprayed into the second environment until all the collected cooled water is within several degrees of the web bulb temperature of the second environment.

3. A cooling method as in claim 2, wherein any unfrozen collected sprayed water from the ice pond formation step is reprayed thereby to subject it to further at least partial freezing.

4. A cooling method as in claim 1, wherein 20% of the total water sprayed into said first environment and said second environment is in the form of particles having a diameter of less than 500 microns.

5. A cooling method as in claim 1, wherein the point at which the transferred cooled water is introduced to the ice pond is set at such a distance from the point at which the further cooled water is removed from the ice pond that the cooled water flows past a relatively large amount of ice.

6. A cooling method as in claim 1, wherein said collected cooled water may alternatively be inputted directly into the load device, this bypassing said ice pond.

7. A method of supplying a cooling capacity through a combination of spray cooling and spray freezing, comprising:

(a) spraying water into a first natural environment having a temperature below the freezing point of the water such that the sprayed water is at least partially frozen as a result of its contact with the first natural environment;

(b) collecting the at least partially frozen sprayed water to form an ice pond;

(c) spraying hot output water from a load device into a second natural environment having a temperature between the temperature of the hot output water from the load device and the freezing point thereof so that the hot output water is cooled by the second natural environment;

(d) collecting said cooled water;

(e) transferring said cooled water to the ice pond for further cooling; and (f) removing the further cooled water from the ice pond and inputting it into the load device.

* * * * *